United States Patent [19]

Burnside

[11] 4,017,077

[45] Apr. 12, 1977

[54] MATRIX TRANSFORMATION PIN BALL MACHINE WITH SCORE MULTIPLIER OPTION

[75] Inventor: Walter M. Burnside, Waukegan, Ill.

[73] Assignee: Bally Manufacturing Corporation, Chicago, Ill.

[22] Filed: July 3, 1975

[21] Appl. No.: 592,925

[52] U.S. Cl. ..... 273/121 A; 273/138 A

[51] Int. Cl.[2] ..... A63F 7/00

[58] Field of Search ..... 273/118 A, 119 A, 120 A, 273/121 A, 122 A, 123 A, 124 A, 125 A, 138 A, 143 R

[56] References Cited

UNITED STATES PATENTS

| | | | |
|---|---|---|---|
| 2,864,619 | 12/1958 | Burnside | 273/121 A |
| 2,932,517 | 4/1960 | Hooker et al. | 273/123 A X |
| 3,120,657 | 2/1964 | Hooker | 273/118 AR |
| 3,275,322 | 9/1966 | Burnside | 273/123 A X |
| 3,399,896 | 9/1968 | Burnside | 273/123 A X |
| 3,642,287 | 2/1972 | Lally et al. | 273/143 R |

*Primary Examiner*—Anton O. Oechsle
*Attorney, Agent, or Firm*—Hibben, Noyes & Bicknell, Ltd.

[57] ABSTRACT

A pin ball-type game with at least one bingo-type matrix on which a winning combination can be formed during play having a matrix transformation means for changing the matrix arrangement to enable a player to obtain a winning combination of maximum score value, and having a score value altering means associated therewith which a player has the option of activating whenever a said winning combination is formed on said matrix in place of accepting the regular score value for the combination, with the score altering means adapted at random to either double the score value normally awarded for the particular winning combinaton or awarding no score for the winning combination.

2 Claims, 3 Drawing Figures

MATRIX TRANSFORMATION PIN BALL MACHINE WITH SCORE MULTIPLIER OPTION

This invention relates generally to an improvement in the scoring and play of an amusement device, and more particularly to an improvement in a bingo-type pin ball game having a matrix transformation means coupled with a score multiplier option feature.

In order to increase the interest in playing a pin ball game which uses a bingo-type matrix to determine winners and score values, a plurality of matrixes or bingo-type cards have been used in a pin ball game, and the matrix cards have been provided with means for transforming the numbers forming the matrixes to obtain a different arrangement of the numbers so that an improved score can be obtained or the likelihood thereof increased (See U.S. Pat. No. 3,120,657). While such matrix transformation means has materially increased th popularity of bingo-type pin ball games, other ways and means for increasing the interest in playing a bingo-type pin ball game are desirable.

It is therefore an object of the present invention to provide an improved score determining means in a bingo-type pin ball game which increases a player's interest in playing the pin ball game.

Figure 1:
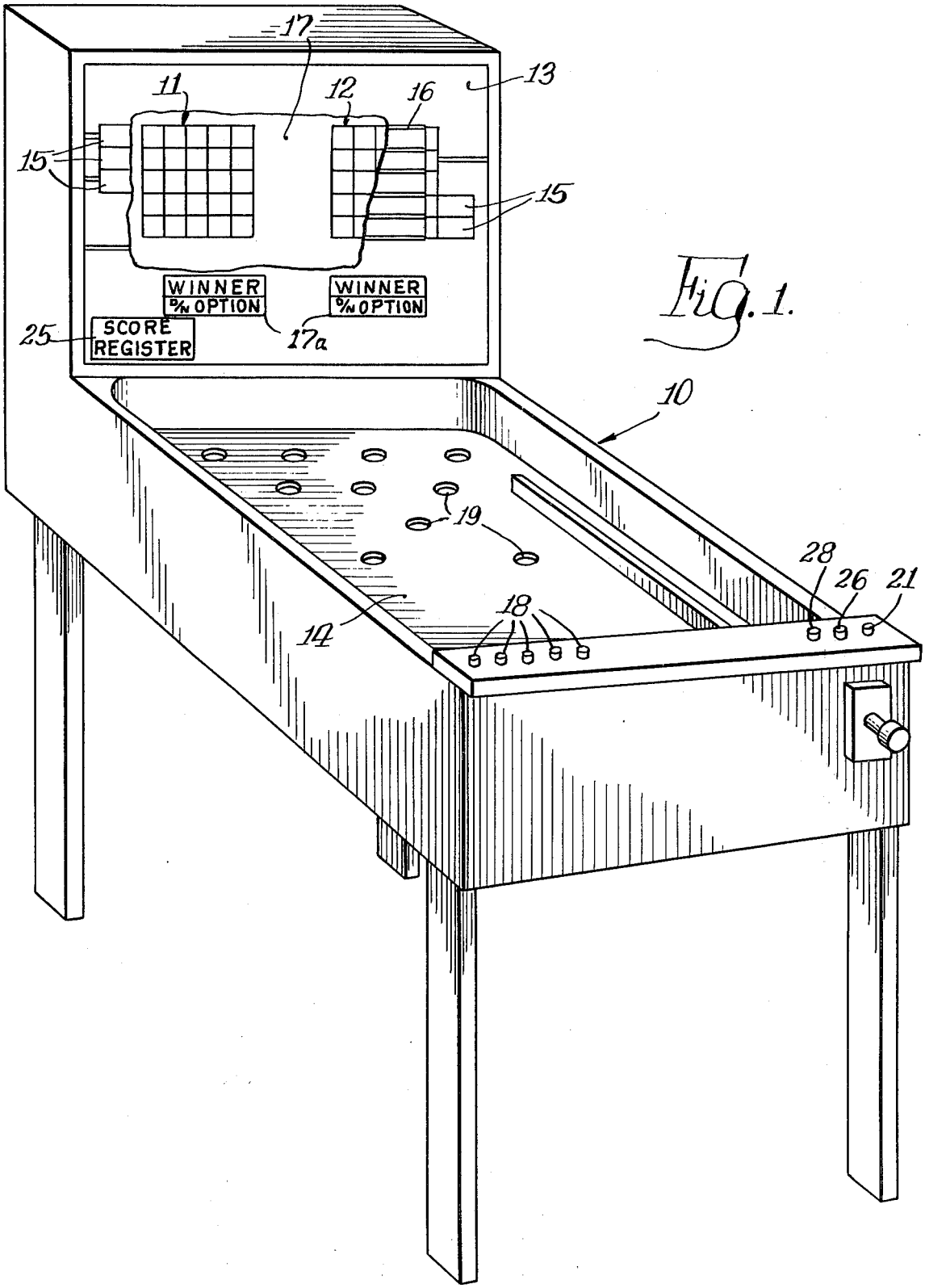
Figure 2:
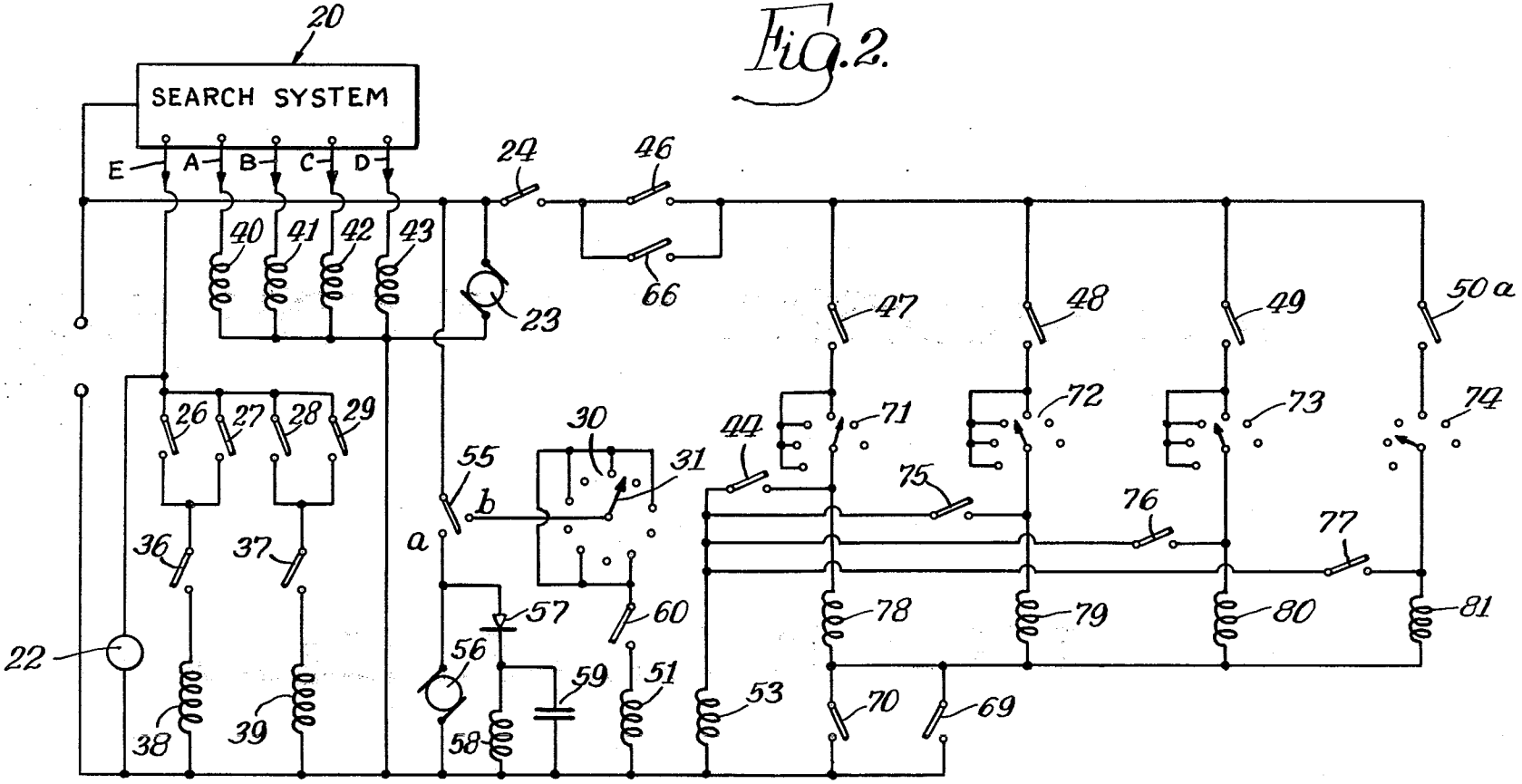
Figure 3:
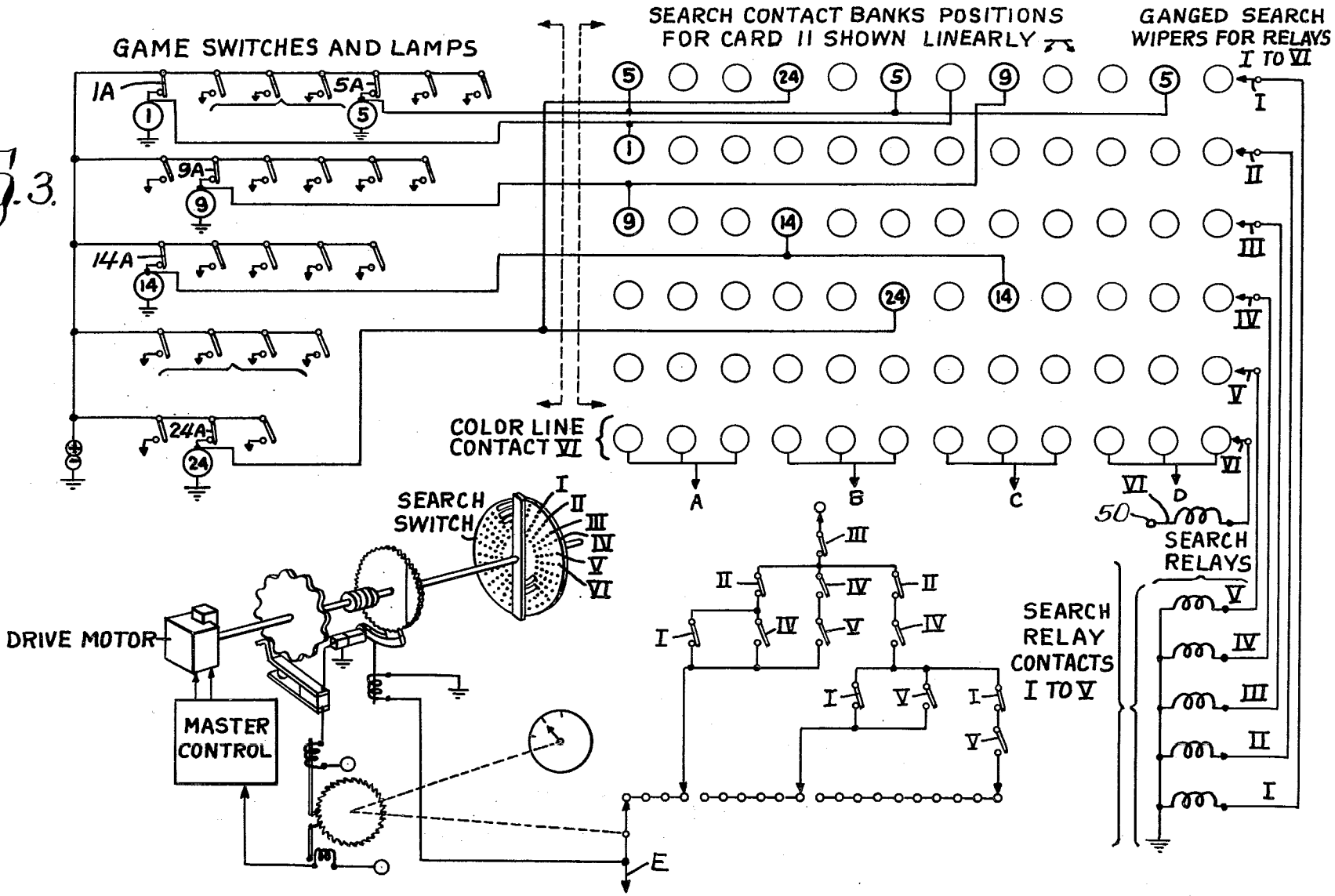

Other objects of the present invention will be apparent from the following detailed descriptions and claims when read in conjunction with the accompanying drawing wherein:

FIG. 1 is a perspective view of a pin ball apparatus having a plurality of bingo-type cards with a matrix transformation means and the score multiplier option feature of the present invention;

FIG. 2 is a circuit diagram for operating the award circuits of the apparatus of FIG. 1; and FIG. 3 is a circuit diagram of the "Search System" of FIG. 2 and corresponds with FIG. 3 of U.S. Pat. No. 2,864,619, modified to show the interconnection thereof with the circuit diagram of FIG. 2.

The form of the present invention illustrated in FIG. 1 of the drawing shows a bingo-type pin ball amusement game apparatus 10 having two side-by-side matrixes or bingo-type cards 11, 12 mounted vertically in a display panel 13 above a generally horizontally disposed pin ball play field 14 of conventional design. The matrixes 11, 12 are preferably interconnected and are comprised of a plurality of indicia or numbers mounted on five parallel horizontaly shiftable bars 15. Each bar 15 is shiftable in its own track 16 which is attached to a lap support panel 17, all disposed behind the display panel 13 which has legends imprinted on the front surface thereof relating to the playing of the bingo-type pin ball game. The matrix transformation means is described in detail in U.S. Pat. No. 3,120,657 which is incorporated herein by reference.

Each of the matrixes or bingo-type game cards 11, 12 which are formed by the bars 15 have five horizontal and five vertical rows of indicia or numbers with two main diagonal rows of indicia. Winning scores are obtained by having the balls which are rolled on the playing field 14 lodge in holes 19 therein corresponding to adjacent numbers in the matrix which form a straight line. A winner is obtained when three or more adjacent numbers in a straight line are illuminated on either one of the matrixes with the highest score value being obtained by having five adjacent numbers illuminated to form a straight line, either horizontally, vertically or diagonally on either card 11 or 12. If desired, the horizontal, vertical and diagonal rows of numbers on each card can be assigned different colors. In the present embodiment four different colors are used to designate different rows of indicia, namely three rows to red, yellow, green and white on each card.

In one preferred form of apparatus embodying the matrix transformation means and having the score multiplier option feature coupled with a winner search system, a player may, before the final pin ball is rolled onto the playing field 14, shift one or more of the horizontally shiftable indicia bar 15 when the operating circuit therefore is closed. Each indicia bar 15 can be moved one space to the left or right of its normal or home position by depressing one of the indicia bar control buttons 18 which controls one of the five indicia bars 15. Any one of the five indicia bars 15 preferably can be operated by its corresponding control button 18 only when a random selector (not shown) which is placed in a master control circuit therefore selects a live contact. In the preferred form it is not possible to shift the indicia bars 15 after the final game ball has been rolled.

When all the game balls have been played and a winning combination appears on either card 11 or card 12, or on both of the cards 11 and 12, a player must activate the winner searching means 20 (which is operatively associated with a score evaluation means, a score award altering means and a score register operating means) by depressing a "Search" button 21 mounted on the front end of the game apparatus 10 as the first step in having a score award recorded in the score register 25. The search system associated with each matrix card 11, 12 in the present embodiment is similar to that disclosed in the applicant's U.S. Pat. No. 2,864,619 which is incorporated herein by reference.

After each matrix card 11, 12 has been searched and evaluated as will be described hereinafter, a signal light 22 will be illuminated when there is a "WINNER" detected on either matrix card 11, 12 and indicating the availability of the "Double-or-Nothing" option feature or the regular award value score. The score evaluation means is connected with a score register operating means which is adapted to advance a score register a number of units corresponding to the particular score value awarded, which can be the score value detected by the score evaluation means, twice said value, or zero.

At this point in the play sequence, the player has the option of having his regular score award recorded in the score register 25 by pressing the "Regular" score register button 26, or the player can elect to play the "Double-or-Nothing" score multiplier option. The "Double-or-Nothing" option is exercised by depressing the "Double-or-Nothing" button 28 which is operatively connected with a score award altering means, including a random selector means 30. If the rotary wiper element 31 of the random selector means 30 stops on a live contact and activates the score award altering or "doubling" circuit, the score award value recorded in the score register 25 will be twice the regular score award value for the particular winning combination detected by the score searching and evaluating means. However, if the random selector means 30 does not activate the score "doubling" circuit, the score which has been detected by the searching means 20 and "stored" in the score evaluation means will not be transmitted to the score register operating means and no score will be recorded for the "WIN" in the score register 25.

After the above option is exercised for the winning combination appearing on matrix card 11, the player has the same option to accept either his regular score or to play the "Double-or-Nothing" option for the winning combination which appears on the second matrix card 12. The latter option is exercised by the player depressing for a second time either the "Regular" score button 26 or the "Double-or-Nothing" score button 28.

With reference to FIGS. 2 and 3 of the drawing which shows schematically the circuit arrangement for operating the matrix card 11 of the apparatus of FIG. 1, including the score altering means comprising the "Double-or-Nothing" option feature, it will be understood by those skilled in the art and familiar with the Burnside U.S. Pat. No. 2,864,619 that the game ball switches 1A . . . 24A (see FIG. 3) control the correspondingly numbered lights relay contacts and switches which form the bingo-type matrix card 11, and effect the closing of three or more of the search relays I through V when there is a winning combination, as described in detail in the Burnside U.S. Pat. No. 2,864,619.

In addition to the five rows of 12 each search relay contacts and co-acting wipers designate I, II, III, IV and V, respectively, in U.S. Pat. No. 2,864,619, there is in the operating circuit of the present apparatus a sixth row of 12 contacts with a co-acting wiper designated "VI". The contacts "VI" are divided into groups corresponding to the different color lines on the matrix card 11. The card 11 has four different color lines; namely, three lines of red (A), three lines of green (B), three lines of yellow (C) and three lines of white (D). As shown in FIG. 3, the movement of the wiper over the contacts of row "VI" is synchronized with the search relay contact wipers I through V so that when there are, for example, three adjacent "hot" contacts in a red line of the matrix card 11, the wiper VI will cause red relay switch "A" to be closed so that relay 40 (see FIG. 2) is activated simultaneously with the signalling of a "WINNER". When there are three adjacent "hot" contacts in one of the other color lines B, C or D, the associated relay 41, 42 or 43, respectively, will be activated. It will also be apparent from FIG. 3 that when any three relay contacts become "hot", a current will flow at "E", causing the "WINNER" light 22 to illuminate window 17*a* in the display panel 13.

If at this time the player elects to have his regular score value recorded, the regular score button 26 is depressed, and without the "Double-or-Nothing" button 28 being depressed, the regular score relay 38 will be energized. Switch 27 on relay 38 will not close, and relay 38 will remain energized as long as there is a voltage at "E" coming from the score searching means 20. Switch 37 on relay 38 will open, preventing the "Double-or-Nothing" relay 39 from being energized. If the "Double-or-Nothing" button 28 is depressed first, relay 39 will be energized and will be held in by its switch 29. Switch 36 which is associated with relay 39 wll prevent relay 38 being energized. It is evident that because of switches 36 and 37, either relay 38 or 39, but not both, can be energized at any given time.

Assuming the regular score button 26 is depressed and the winner is in a "red" line on matrix card 11, relay 40 will be energized and will close switches 47 and 44. As shown in FIG. 2, switch 46 which is associated with regular score button 26 and relay 38 will be closed, as will the switch 47 and switch 44 which are operatively associated with relay 40. The switch 60 on the double relay 51 is open, since the double relay 51 has not been energized. At the beginning of this regular score recordal sequence, the rotary switch 71 will be closed, and the pulse switch 24 which is driven by motor 23 and continuously follows an "on-off" sequence will produce a series of voltage pulses at the pulse counter coil 78 and also at the score register coil 53. Each pulse at coil 78 will advance the rotary switch 71 until it opens at the predetermined number of pulses, causing the regular score value to be registered in the score register associated with register coil 53 corresponding to the regular score value of the "WINNING" combination displayed in the matrix 11 and detected by the score evaluation means 20 (see FIG. 3).

If the "Double-or-Nothing" button 28 is pressed instead of the regular score button 26, relay 39 will be energized, and switch 55 will move from contact *a* to contact *b*, thereby stopping motor 56 which drives the rotary wiper 31 of the random selector rotary switch 30 and de-energizing relay 58. Relay 58 when de-energized will close switch 60 and energize score doubling relay 51, provided the rotary wiper 31 of the random selector rotary switch 30 happens to have stopped on a live contact. Because of the capacitor 59 and diode 57, relay 58 will not de-energize immediately after switch 55 opens and cuts the voltage from diode 57. This delay enables the motor 56 to come to a stop before switch 60 closes.

As switches 47 and 44 have been closed by relay 40 and switch 66 has been closed by relay 39, coils 53 and 78 will receive voltage pulses until rotary switch 71 opens. In this case, switch 69 will be open, and current will flow in coil 78 only when alternator switch 70 is closed, which will be on every other pulse, since switch 70 makes contact alternately with the closing of the pulse switch 24. Accordingly, the score register coil 53 will be activated twice as often as coil 78 and double the number of units of score value will be registered compared with the case where the regular score button 26 was depressed and switch 69 was closed.

In the event a winning combination is detected in a yellow line, the search and score evaluation means will energize relay 41, relay 42 if in a green line, and relay 43 if in a white line. Relay 41 will close switches 48 and 75, relay 42 will close switches 49 and 76, and relay 43 will close switches 50*a* and 77. Coil 79 and rotary switch 72 are involved in score recording for the yellow line scores, coil 80 and rotary switch 73 for the green line score, and coil 81 and rotary switch 74 for the white line score. The same circuit logic prevails for all four color lines.

I claim:

1. In a pin ball game apparatus having a bingo-type matrix, a plurality of game ball switches adapted to be closed by game balls as a result of operation of the game, combinations of said game ball switches adapted to determine a nominal score award value, search relay contacts connected with said game ball switches, contact wiper means for traversing said search relay contacts to detect active electrical circuit connections, a plurality of search relays each adapted to be actuated by said wiper means when contacting said active circuit connections, relay switches actuated by said search relays for establishing score award circuit corresponding to certain of said active electrical circuit connections, score register means associated with said relay switches for recording any said score award value, said score register means having score register operating means adapted to transmit to said score register means for recording therein a score award value, a score award altering means adapted to be operatively connected with said score register operating means whenever any said score award circuit is established, and said score award altering means adapted to select at random for transmission to said score register means between a score award value greater than said nominal score award value and no score award value.

2. A pin ball game apparatus as in claim 1, wherein said score award altering means when operatively connected with said score register operating means being adapted to select at random for transmission to said score register means between a score award value double said nominal score award value and no score award value.

* * * * *

UNITED STATES PATENT AND TRADEMARK OFFICE

CERTIFICATE OF CORRECTION

PATENT NO. : 4,017,077

DATED : April 12, 1977

INVENTOR(S) : Walter M. Burnside

It is certified that error appears in the above-identified patent and that said Letters Patent are hereby corrected as shown below:

Col. 1, line 20, "th" should read --the--;

Col. 1, line 51, "lap" should read --lamp--;

Col. 3, line 54, "will not close" should read --will now close--;

Col. 3, line 62, "wll" should read --will--.

Signed and Sealed this

*fifth* Day of *July 1977*

[SEAL]

*Attest:*

RUTH C. MASON
*Attesting Officer*

C. MARSHALL DANN
*Commissioner of Patents and Trademarks*